United States Patent [19]

Chappell

[11] 4,133,537

[45] Jan. 9, 1979

[54] MULTI-LEVEL CHESS BOARD

[76] Inventor: Max G. Chappell, 485 Printy Ave., Milpitas, Calif. 95035

[21] Appl. No.: 710,208

[22] Filed: Jul. 30, 1976

[51] Int. Cl.[2] ..... A63F 3/02

[52] U.S. Cl. ..... 273/241; 273/285

[58] Field of Search ..... 273/131, 130 AC, 131 AC, 273/136 GB, 241

[56] References Cited

U.S. PATENT DOCUMENTS

| | | | |
|---|---|---|---|
| D. 200,109 | 1/1965 | Hirsch | 273/130 AC |
| 3,399,895 | 9/1968 | Beach | 273/136 R |
| 3,684,285 | 8/1972 | Kane | 273/131 AC |
| 3,767,201 | 10/1973 | Harper et al. | 273/131 AC |
| 3,884,474 | 5/1975 | Harper | 273/130 AC |

FOREIGN PATENT DOCUMENTS

| | | | |
|---|---|---|---|
| 1283840 | 8/1972 | United Kingdom | 273/131 AC |

OTHER PUBLICATIONS

"Space Chess"; *House Beautiful;* Nov. 1967; p. 214.

*Primary Examiner*—Richard C. Pinkham
*Assistant Examiner*—Harry G. Strappello
*Attorney, Agent, or Firm*—Ralph S. Branscomb

[57] ABSTRACT

An artistically arranged three dimensional chess set has eight vertically spaced stages, the uppermost and lowermost stage comprising a single square with the stages including progressively increasing numbers of squares toward the center to a total of 64 squares and the upper and lower groups of three stages each defining a totality of sixteen squares. The stages are maintained in spaced relation by a stand which is preferably comprised of a plurality of disengageable members so that the set may be disassembled and arranged in a relatively small container for marketing and storage.

8 Claims, 13 Drawing Figures

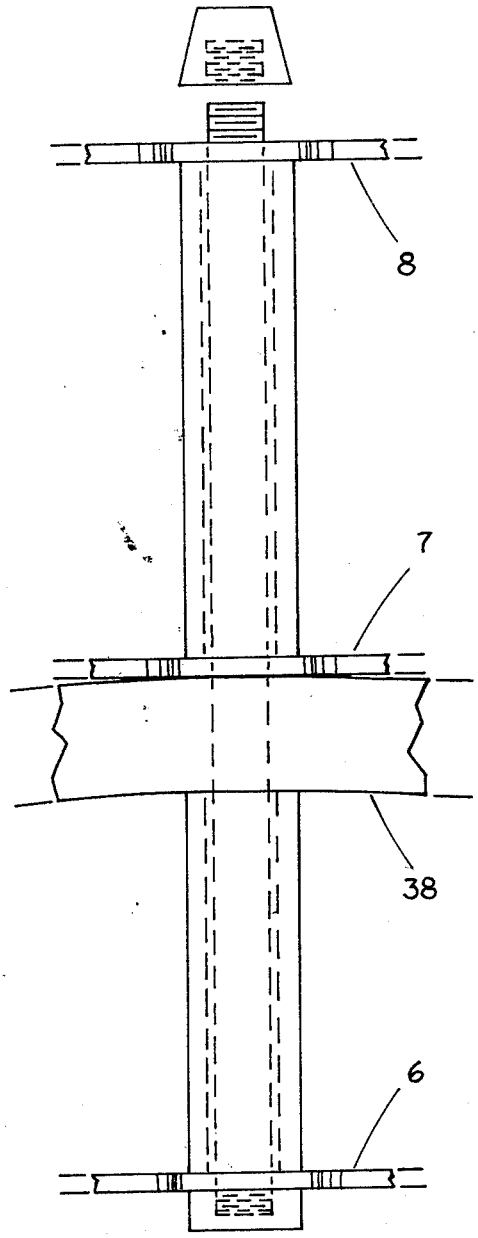
FIGURE 7
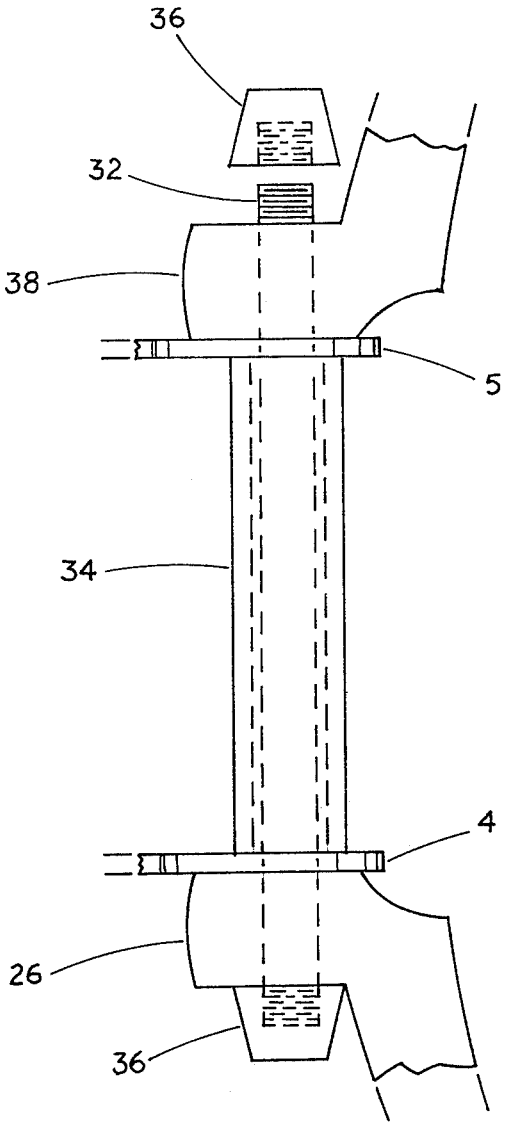
FIGURE 8
FIGURE 9
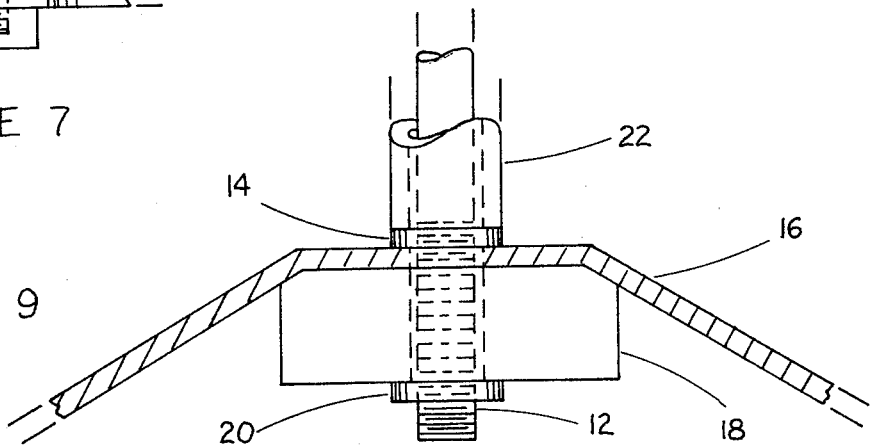

MULTI-LEVEL CHESS BOARD

BACKGROUND OF THE INVENTION

Numerous variations on the basic game of chess have been developed over the years, and undoubtedly have proliferated during the recent upsurge in the general public interest in the game. These modifications have included boards designed for three or more players using more than two sets of pieces, and several versions of three dimensional chess, many of which are restricted to three different levels and a common type having 64 squares in each of these three levels. This arrangement is simple to assemble and easy to play on since the extrapolation of the basic chess rules from two dimensional playing into three is obvious.

SUMMARY OF THE INVENTION

The present invention is a chess board which is not merely a duplicate or a triplicate of a conventional board but comprises eight uniquely arranged stages having varying numbers of squares thereon such that the total number of squares is maintained at sixty-four, consistent with two dimensional chess. These stages are arranged to have incrementally increasing numbers of squares from the vertical extremities toward the center, two of the square stages having an additional pair of squares appended thereto so that the upper and lower groups of three stages each contain sixteen squares to provide for initial positioning of the pieces of each player, and the total number of squares thus being increased from sixty to sixty-four.

The stages are connected and maintained in spaced relation by a number of threaded posts or shafts having spacer sleeves thereon and a pair of support braces, these supports all being dismantable so that the structure can lie essentially flat for storage and shipping, and the points of connection of the stages to the supports being at the corners thereof to provide easy access to the stages during play.

BRIEF DESCRIPTION OF THE DRAWINGS

FIG. 7 is a detail of one of the support pillars for the upper three stages showing the end cap removed;

FIG. 8 is a detail of one of the central support pillars showing the upper end cap removed;

FIG. 9 is a detail, partially in section, of the means of attachment of the board structure to the base;

DETAILED DESCRIPTION OF THE PREFERRED INVENTION

Figure 1:
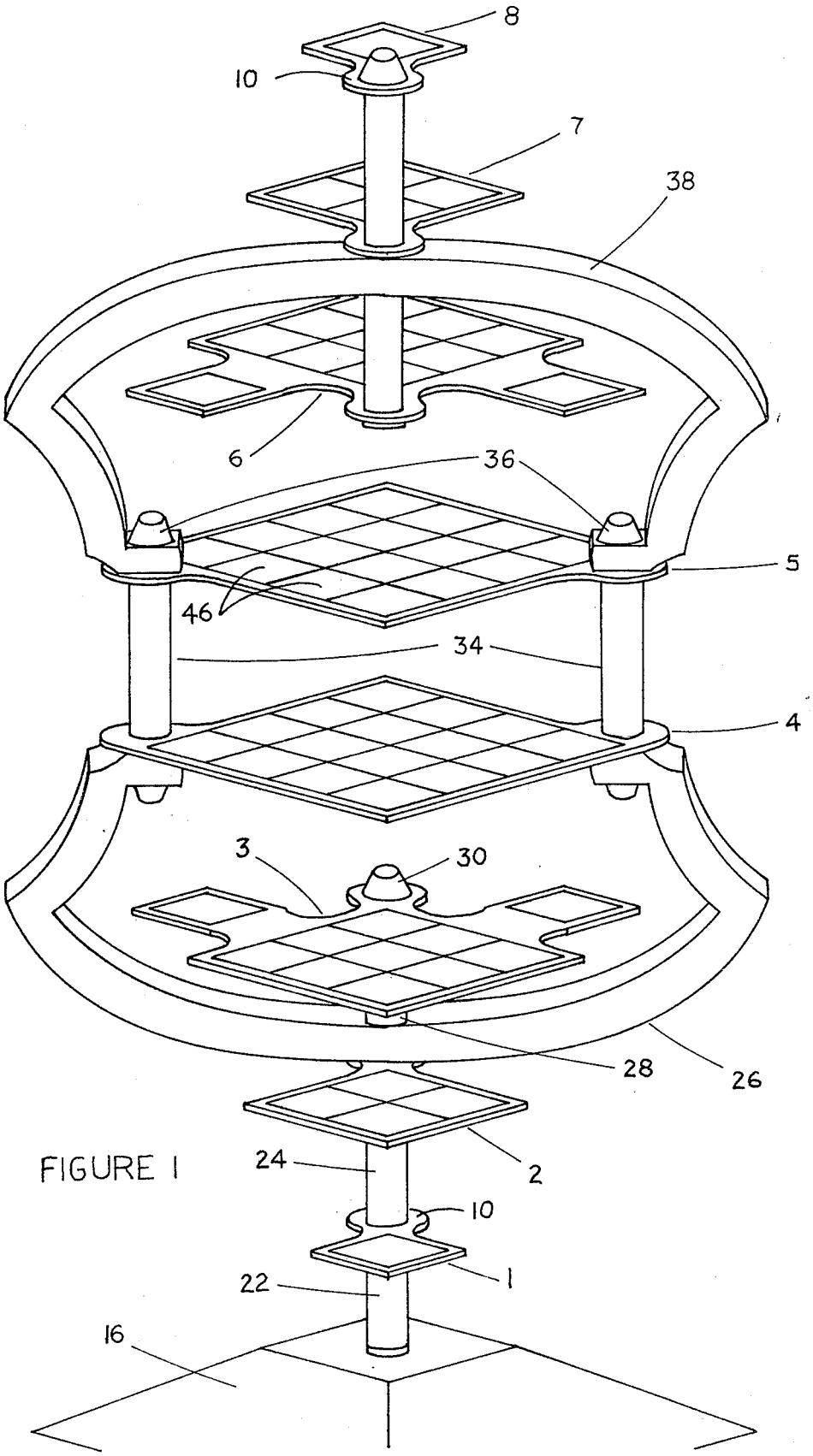
FIG. 1 is a perspective view of the chess board.
Figure 4:
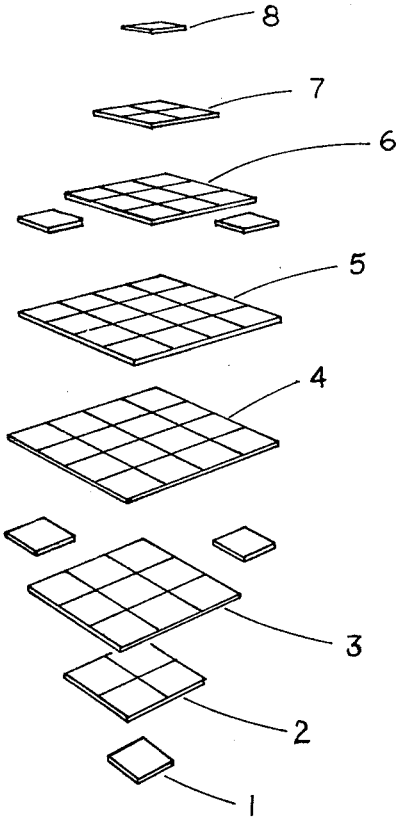
FIG. 4 is a perspective view of the platforms removed from the supporting members to better illustrate the vertical alignment of the individual squares.
Figure 2:
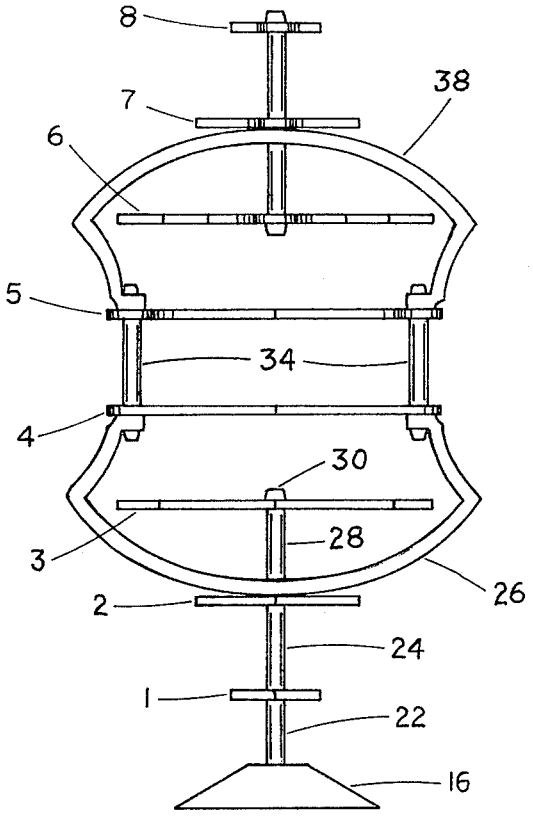
FIG. 2 is a side elevational view of the chess board of FIG. 1.
Figure 3:
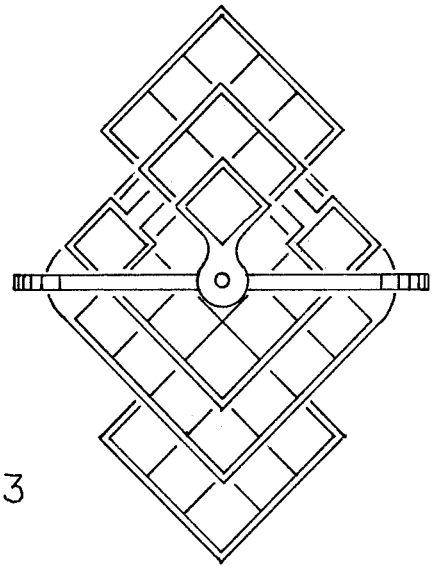
FIG. 3 is a top elevation of the chess board of FIG. 1.

An overview of the chess board is provided in FIG. 1 in which the eight separate stages of the board are consecutively numbered one through eight from bottom to top. The lowermost three stages each have a lobe ten extending from one corner thereof and a hole is provided in each lobe to accomodate a vertical shaft 12, as shown in FIG. 9, the lower end of this shaft passing through the upper surface of a support base 16 having an anchoring plug 18 thereunder and a nut 20 is used to secure the bottom of the shaft. Resting on the base and coaxial with the shaft are nut 14 and a cylindrical sleeve 22 which together space stage 1 from the base. As can be seen in FIG. 1 and 2, a similar sleeve 24 is used to space stages 1 and 2, and immediately above and resting on stage 2 is an inverted, somewhat U-shaped bracket 26 which has a central opening therein to accomodate the shaft 12. A third sleeve 28 is engaged on the shaft immediately above the bracket 26 to space stage 3 therefrom, and the first three stages together with the bracket are secured together on the shaft 12 by a threaded end cap 30.

The ends of the bracket 26 are each provided with a vertical bore and through these bores are extended shafts 32 which by means of sleeves 34 and threaded end caps 36 connect stages 4 and 5 together and join the lower bracket 26 to an identical bracket 38 in reflected position as shown in FIG. 1 and detailed in FIG. 8. The upper three stages are mounted to the bracket 38 and mutually spaced in identical fashion to the lower three and will not be described in further detail.

This support structure is subject to some variation but the arrangement shown is practical and aesthetically appealing, especially if the vertical shafts used to join the stage are made of brass and the spacing sleeves constructed of transparent plastic so that the brass is visible. The support brackets 26 and 30 are also preferably constructed of transparent plastic and by removing the end caps from the shafts the entire assembly is easily dismantled and stored in a relatively small space.

Figure 12:
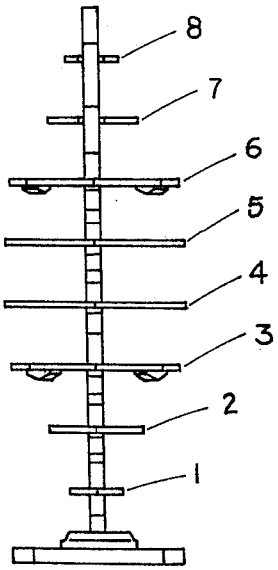
FIG. 12 is a front elevation view of the modified version of the chess board.
Figure 11:
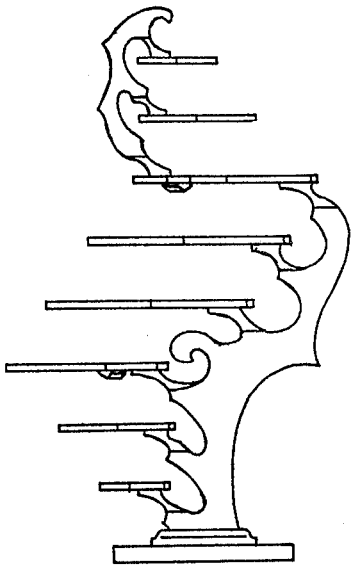
FIG. 11 is a side elevation view of the modification shown in FIG. 10.
Figure 10:
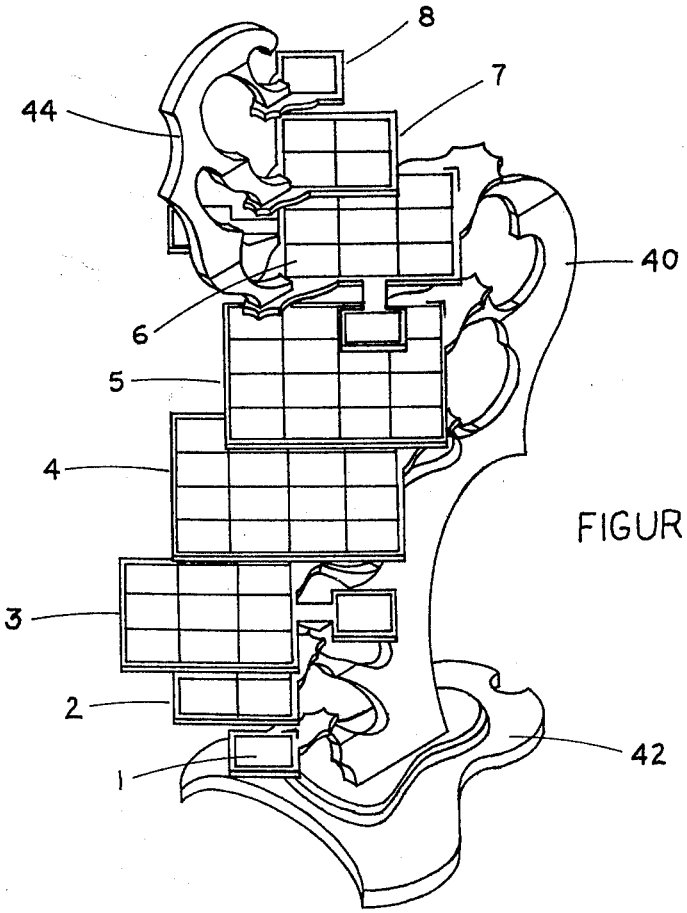
FIG. 10 is a perspective view of a slight modification of the chess board having a different support structure.

In modification of the support structure shown in FIGS. 10–12 a single support member 40 mounted in a base 42 maintains the lower six stages in properly spaced relation and a second, upper support 44 somewhat similar in general design to support 40 connects stages 7 and 8 to stage 6. The apparatus in this modification is not collapsible as in the first version but the supporting structure can be made from carved wood or the like and is clearly very artistically conceived. The arrangement of stages is identical in both embodiments.

An important part of the invention lies in the configuration of the various stages. It can be seen that the vertical support posts and the brackets 26 and 38 define a vertical plane, and the stages are arranged according to a generally symmetrical pattern in which radial symmetry exists about a point localized centrally in space between stages 4 and 5. Each of the stages is marked off to indicate one or more squares 46 which will be termed "playing squares" in the claims, and the aggregate square comprised of an equal number of rank and file of playing squares is termed "stage square" in the claim to differentiate the larger composite squares from the unitary playing squares. Approaching the center of the apparatus from each end it can be seen that the number of squares in the platforms increases as the square of the increment, that is, stages 1, 2, 3, and 4 have one, four, nine, and sixteen squares therein respectively, and same is true for squares 8, 7, 6, and 5, respectively, there being a slight variation from this pattern in that stages 3 and 6 are each provided with an additional pair of squares marked on extension platforms 48 of those stages, so that the total number of squares is sixty-four and the number of squares in the upper three and lower three stages is sixteen each.

As with any chess or checker board, the squares are alternately light and dark in two dimensions, and the same concept is extended into three dimensions in the present invention. The vertical alignment of the stages and the squares is very important, as is the initial positioning of the pieces prior to the beginning of the game because when the board arrangement is varied beyond a simple three level structure, most arbitrary arrangements of the various levels would result in producing a game having anomalies and inescapable traps inherent in the rules and method of play which would not likely be initially apparent but would reduce the enjoyment and quality of the game. The present arrangement has proven itself through experience to be free of such drawbacks and the arrangement of spaces is thus important.

As can be seen in FIG. 1, there is a vertical plane which is orthogonal to the plane defined by the brackets 26 and 38 and which bisects every stage diagonally and passes through the vertical support posts. The two central stages are horizontally staggered in the direction of this orthogonal plane one diagonal square as can best be seen in FIGS. 5 and 6, and the stages adjacent stages 4 and 5 are similarly staggered one diagonal square outwardly of respective stages 4 and 5, with the projecting squares 48 being vertically aligned with corner squares of the respective stages 4 and 5.

Figure 5:
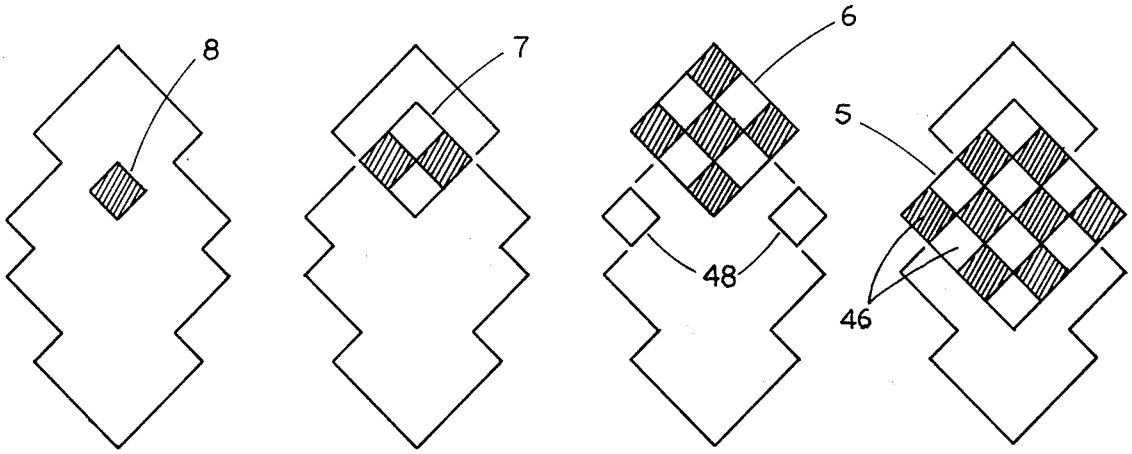
FIG. 5 is a plan view of the top four stages of the board arranged in descending order from left to right showing the positioning of each stage on the overall plan view of the remaining stages.

With reference to stage 66 of FIG. 5, the square at the inside corner of the stage square of that stage which will be referred to as the innermost square, is vertically aligned with the innermost square of stage 7 and the single square (also the innermost square) of stage 8, the same being true of the squares 1 and 2 relative to the bottom half of the board according to the above-mentioned scheme of symmetry.

The innermost squares of stages 3 and 6 each have a pair of adjacent playing squares which are peripheral to the stage squares, and these adjacent squares are the ones which support the platform 48 spaced one square away from the respective stages squares.

Figure 13:
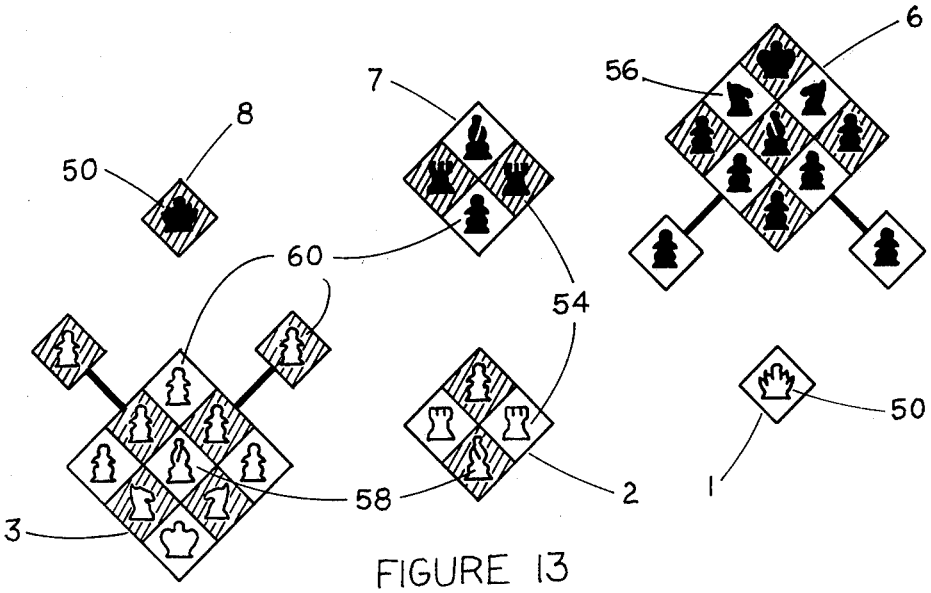
FIG. 13 is a plan view of stages one, two, three, six, seven, and eight showing the initial positions of the playing pieces.

The initial arrangement of the playing pieces, illustrated in FIG. 13, locates the two queens 50 on the single square stages 1 and 8, and the kings 52, rooks 54, knights 56, bishop 58, and pawns 60 being positioned as shown. The two dimensional moves of the pieces on each stage are conventional, with the exception of the pawns on the extended squares 48 which are separated from the main portion of their respective platforms so that they are restrained to vertical movement. Pieces capable of moving along diagonals can move along any vertical diagonal comprised of all squares having the same color, and pieces which move along rows and columns can also move vertically. If a player succeeds in moving a pawn to the square of the opposing queen, he may "Queen" that piece, and aside from other slight modifications the rules are identical to those of two dimensional chess.

The chess board thus described provides a fascinating arrangement for a game of chess as well an artistically appealing design, and maybe either constructed as a permanent work of art or in easily collapsible form to permit simplified storage.

I claim:

1. A multi-level chessboard comprising:

(a) a frame;

(b) eight vertically spaced horizontal stages mounted on said frame;

(c) each of said stages defining at least one playing square;

(d) the uppermost three of said stages together defining exactly sixteen playing squares and the lower most three of said stages also together defining exactly sixteen playing squares whereby the black and white chess pieces may be arranged respectively on the upper and lower three stages, and the two remaining central stages define an initially open field.

2. A chessboard according to claim 1 wherein each of said top three stages defines in a square arrangement 1, 4, and 9 playing squares respectively from the top stage down, one of said top three stages includes a pair of appended coplanar platforms which define the remaining two playing squares of the sixteen squares defined by said uppermost three stages, and said lowermost three stages are radially symmetrical about a point central to said multi-level chessboard relative to said upper three stages.

3. A chessboard according to claim 1 wherein said two remaining central stages each defines exactly sixteen playing squares such that the total number of squares defined by all of said stages combined is exactly 64.

Figure 6:
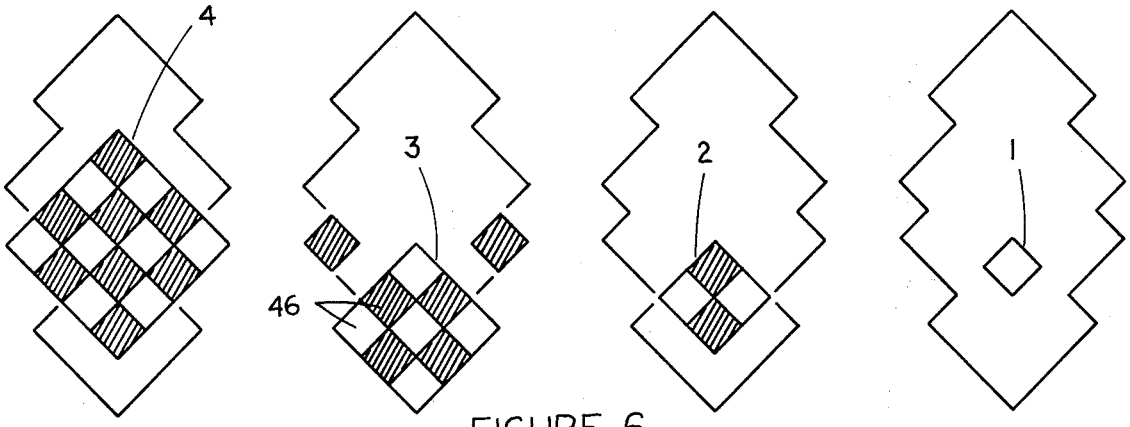
FIG. 6 includes views similar to those of FIG. 5 but for the lower four stages in descending order.

4. A chessboard according to claim 1 wherein each of said eight stages defines a stage square comprised of one or more playing squares arranged in equal numbers of rows and ranks, and each of said stage squares is diagonally aligned relative to the remainder of said stage squares such that one diagonal of each of said stage squares lies in a vertical plane common to one diagonal of each of the other of said stage squares, and each of said stage squares has a center which is horizontally displaced along said central plane with respect to the stage squares immediately vertically adjacent thereto, so that said stage squares are horizontally staggered from one to the next in the direction of said common plane and arranged as shown in FIGS. 5 and 6 of the drawings.

5. A chessboard according to claim 4 wherein each of the upper three and lower three of said stage squares is arranged as shown in FIGS. 5 and 6 of the drawings and has a playing square which is diagonally bisected by said common plane and is the innermost square of the respective stage square relative to the overall chessboard, and the innermost squares of said top three stage squares are vertically aligned and the innermost squares of the bottom three squares are vertically aligned.

6. A chessboard according to claim 5 wherein the third stage from the top and the third stage from the bottom of said multi-level chessboard each defines a stage square of nine playing squares, and each of said nine playing square stage squares supports a platform spaced one square therefrom and defining one playing square vertically aligned with a corner square of the adjacent center stage as shown in FIGS. 5 and 6 of the drawings.

7. A multi-level chess board comprising:

(a) A frame having means to support same above a surface;

(b) A plurality of horizontally extended vertically spaced stages;

(c) A plurality of separable members joining adjacent ones of said stages together;

(d) Two of said stages being quadralateral and vertically centered between the remaining stages;

(e) A pair of sleeves separating diagonal corners of one of said vertically centered stages from the respective diagonal corners of the other of said vertically centered stages;

(f) Each of said sleeves having a threaded shaft passing therethrough, said shafts also passing through said centered stages and having threaded end caps secured to the ends of said threaded shafts;

(g) Two generally U-shaped braces secured at their ends by said caps to said threaded shafts, said braces comprising an upper brace and a lower brace and extending from the ends thereof in opposite vertical directions;

(h) Three of said stages being upper stage diagonal above said centered stages and three of said stages being lower stage diagonal below said centered stages;

(i) Said U-shaped braces each having a central vertical bore therethrough and each of said bores having a shaft extended therefrom in the direction opposite said centered stages;

(j) Said upper stages being mounted on one of said extended shafts above said upper brace and said lower stages being mounted on the other of said extended shafts below said lower brace.

8. A multi-level chess board according to claim 7 and including a support base for said chess board, the extended shaft to which the said lower stages are mounted extending into and removably secured to said base.

* * * * *